US007059410B2

(12) United States Patent
Bousche et al.

(10) Patent No.: US 7,059,410 B2
(45) Date of Patent: Jun. 13, 2006

(54) METHOD AND SYSTEM FOR REDUCING LONGITUDINAL FLUID FLOW AROUND A PERMEABLE WELL

(75) Inventors: Olaf Jean Paul Bousche, Rijswijk (NL); Douwe Johannes Runia, Rijswijk (NL)

(73) Assignee: Shell Oil Company, Houston, TX (US)

( * ) Notice: Subject to any disclaimer, the term of this patent is extended or adjusted under 35 U.S.C. 154(b) by 388 days.

(21) Appl. No.: 10/296,747

(22) PCT Filed: May 31, 2001

(86) PCT No.: PCT/EP01/06271

§ 371 (c)(1),
(2), (4) Date: Nov. 27, 2002

(87) PCT Pub. No.: WO01/92681

PCT Pub. Date: Dec. 6, 2001

(65) Prior Publication Data

US 2003/0184178 A1 Oct. 2, 2003

(51) Int. Cl.
*E21B 33/124* (2006.01)

(52) U.S. Cl. ..... 166/296; 166/191; 166/205; 166/376; 166/387

(58) Field of Classification Search ..... 166/296, 166/376, 387, 191, 202, 205, 227, 173, 174
See application file for complete search history.

(56) References Cited

U.S. PATENT DOCUMENTS

| | | | | |
|---|---|---|---|---|
| 3,670,815 | A * | 6/1972 | Brown | 166/136 |
| 4,129,308 | A * | 12/1978 | Hutchison | 277/335 |
| 4,229,149 | A * | 10/1980 | Turner | 417/554 |
| 4,576,042 | A | 3/1986 | Johnson | |
| 5,033,551 | A | 7/1991 | Grantom | |
| 5,261,488 | A | 11/1993 | Gullet et al. | |
| 5,588,487 | A | 12/1996 | Brywant | |
| 5,803,177 | A | 9/1998 | Hriscu et al. | |

FOREIGN PATENT DOCUMENTS

| | | |
|---|---|---|
| EP | 533451 A2 | 3/1993 |
| JP | 48-74506 | 10/1973 |
| JP | 62-288689 | 12/1987 |
| JP | 3-24194 | 2/1991 |

* cited by examiner

*Primary Examiner*—Zakiya Walker
(74) *Attorney, Agent, or Firm*—Rachael Stiegel

(57) ABSTRACT

A method for reducing longitudinal flow of fluids through an annular space surrounding a permeable well tubular, such as a slotted liner or a sandscreen, in an inflow region of an oil and/or gas production well having: arranging a series of collapsed resilient sealing rings at regular longitudinal intervals around the permeable tubular before lowering the tubular into the well by means of tape and/or a binder which dissolves downhole; placing the tubular in the inflow region of the well; and allowing the tape and/or binder to dissolve, thereby allowing the resilient sealing rings to expand radially in the annular space surrounding the permeable tubular.

6 Claims, 2 Drawing Sheets

Fig.2.
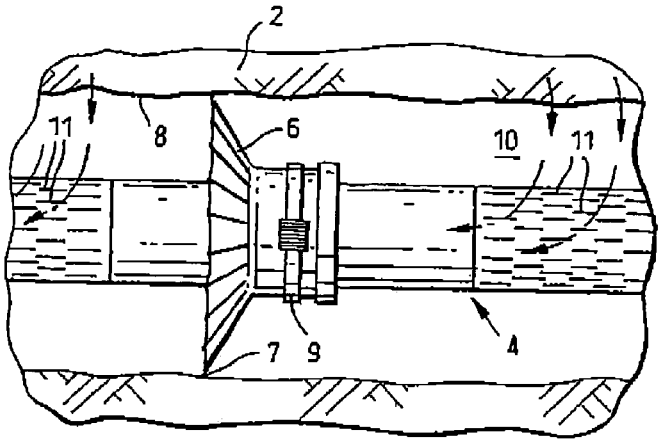
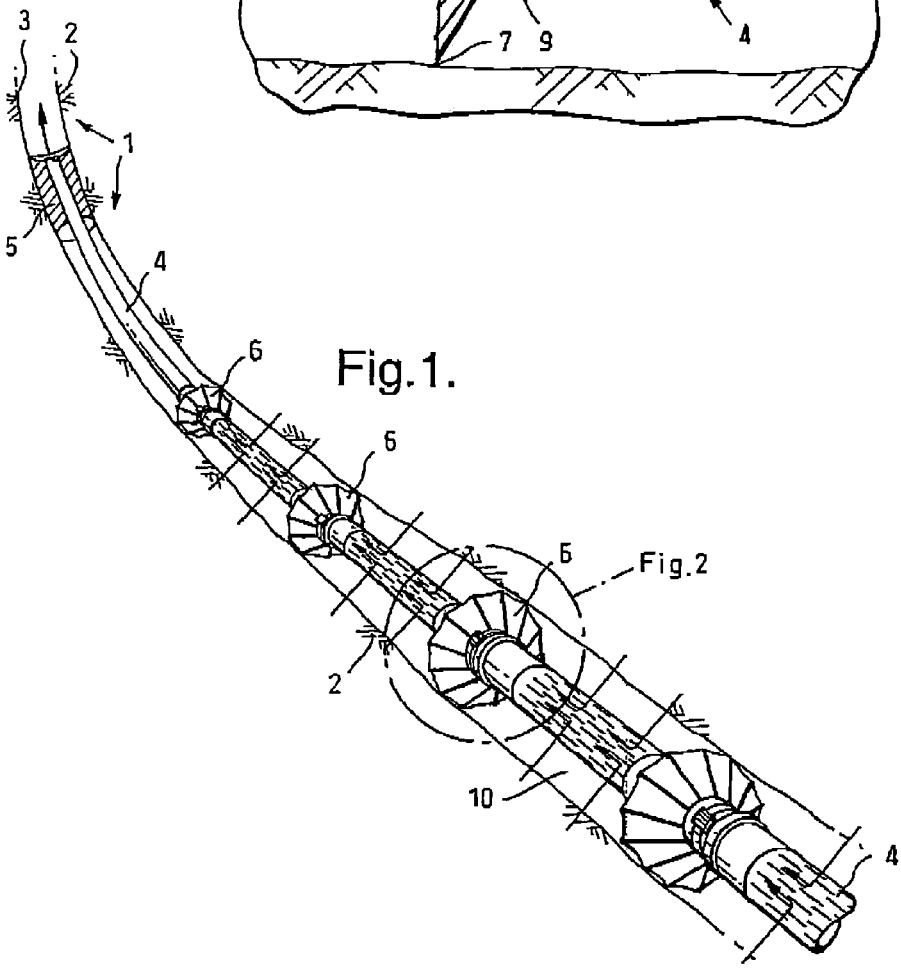
Fig.1.

METHOD AND SYSTEM FOR REDUCING LONGITUDINAL FLUID FLOW AROUND A PERMEABLE WELL

FIELD OF THE INVENTION

The invention relates to a method and system for reducing longitudinal flow of fluids through an annular space surrounding a permeable well tubular, such as a slotted liner or a sandscreen, in an inflow region of an oil and/or gas production well.

BACKGROUND OF THE INVENTION

Modern wells have inflow regions which may have a length up to ten kilometers. In these inflow regions elongate permeable tubulars such as slotted liners, expandable slotted tubulars and/or sandscreens may be arranged which preserve the integrity of the borehole and prevent influx of solids and erosion of the borehole wall during production of oil and/or gas.

However, around these permeable tubulars an annular space of a considerable length may be present or created during production as a result of erosion. This erosion may increase as the eroded annulus may increase in length and width and as a result in some wells the fluid flow through the annulus is equal to or even larger than the production through the interior of the permeable tubular.

Logging procedures which employ downhole spinners that are rotated by the fluid flux inside the tubular will not detect the addition fluid flux through the annulus and may therefore create an Impression that the influx in some regions of the well is smaller than it is in reality. Ultimately this has led to limited production campaigns.

U.S. Pat. No. 4,576,042 discloses a flow basket comprising an umbrella type configuration of petals which are expanded by moving a sleeve relative to a shaft. U.S. Pat. No. 5,033,551 discloses a frusto conical cup which is released downhole by removing a sleeve from the cup after placement of the cup at the top of a wellscreen in a well.

A disadvantage of the known methods is that they require downhole manipulation of well equipment which is a complex and time consuming procedure that is not suitable for installation of a series of seals at short intervals along the length of an inflow region of a well.

SUMMARY OF THE INVENTION

The present invention aims to solve the problem of longitudinal annular flow around permeable well tubulars in an economical and effective manner.

BRIEF DESCRIPTION OF THE DRAWINGS

The invention will be described in more detail, by way of example with reference to the accompanying drawings in which the examples should not be construed to limit the scope of the invention.

FIG. 1 is a schematic three-dimensional view of a horizontal inflow region of a well in which a production liner is present which is equipped with a series of sealing rings according to the invention;

FIG. 2 is a side view, at an enlarged scale, of one of the sealing rings and a section of the production liner shown in FIG. 1;

DETAILED DESCRIPTION OF THE INVENTION

Figure 3:
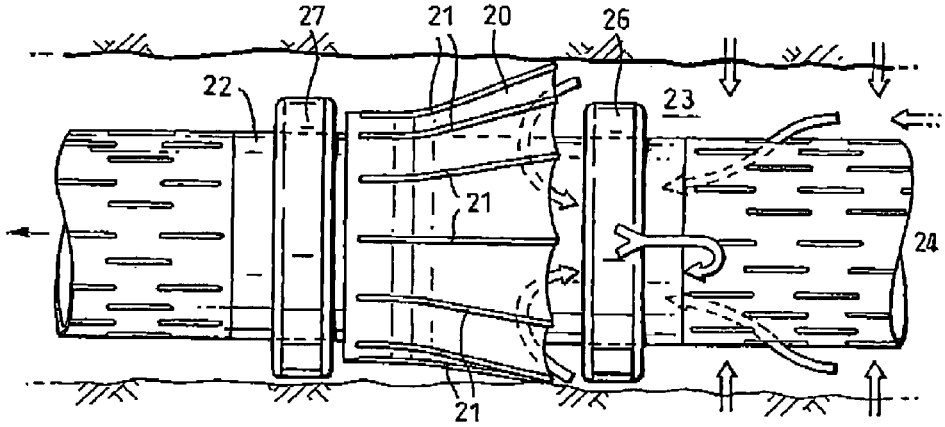
FIG. 3 is a side view of an expanded alternative embodiment of a sealing ring according to the invention which is wrapped around a production liner during installation.

The method according to the invention comprises:

arranging at least one resilient sealing ring around the permeable tubular before lowering the tubular into the well;

constraining the ring in a collapsed position around the tubular by means of a tape and/or binder which gradually dissolves in a downhole environment;

placing the tubular in the inflow region of the well; and allowing the tape and/or binder to dissolve thereby allowing at least part of the resilient sealing ring to expand radially in the annular space surrounding the permeable tubular.

Preferably a series of resilient sealing rings are arranged at regular longitudinal intervals along the length of the permeable tubular and each sealing ring has one end which is permanently clamped to the permeable tubular and a resilient lip-shaped other end which is temporarily clamped around the tubular during installation of the tubular in the well and which is released after installation such that the resilient lip-shaped other end unfolds itself and expands radially.

In such case it is preferred that the resilient lip-shaped other end of each sealing ring is temporary clamped around the tubular during installation using a tape and/or binder which dissolves gradually in the downhole environment.

During installation the lip-shaped ends of the sealing rings may face forward, i.e. against the running direction, and are collapsed tightly against the outside of the tubular by using a suitable metal binder, restrainer and/or tape. The metal binder or restrainer or tape may have a melt point just below the static temperature of the closed-in well. Alternatively the tape may be made of a polymer that slowly dissolves in the downhole environment, such as natural rubber which dissolves in aromatic oils. If required wash cocktails can be designed to enforce the removal of the restraining binder or tape. Thus, after installation and flushing away of the restraining binder or tape the resilient lip-shaped end of the sealing ring will unfold in the annular space between the permeable well tubular and the open hole, thus diverting fluid flow into the tubular. The folded sealing rings may be run in combination with a stand-off and/or inside a bow spring centralizer to avoid damage while running in.

The system according to the invention comprises a series of sealing rings arranged at regular longitudinal intervals around a permeable well tubular, each ring having one end which is permeably connected to the outer wall of the tubular and another resilient lip-shaped other end.

The invention will be described i more detail, by way of example with reference to the accompanying drawings in which:

DETAILED DESCRIPTION OF THE DRAWINGS

Referring now to FIG. 1 there is shown a gas and/or oil production well 1 which traverses an underground formation 2. The upper, substantially vertical, part of the well comprises a casing 3 which is cemented in place, The lower, substantially horizontal, inflow zone of the well is provided with a slotted production liner 4 which is secured to the lower end of the casing 3 by an expandable annular packer 5.

The production liner 4 is provided with a series of expandable sealing rings 6 which are distributed at regular intervals along the length of the production liner 4. As shown in FIG. 2 each sealing ring 6 consists of a swab-cup of which the free end 7 faces the borehole wall 8 and the other end is secured to the liner 4 by a hose clamp 9.

The sealing rings 6 urge the oil and/or gas that flows into the wellbore to flow in a substantially radial direction through the annulus 10 and the slots 11 into the interior of the liner 4, so that longitudinal flow of fluids through the annulus 10 is minimised.

In the region of each sealing ring 6 the liner 4 is unslotted to provide rigidity and to provide an area where accurate flow measurements can be made within the liner 4 by e.g. a spinner or injection of tracer chemicals.

Figure 4:
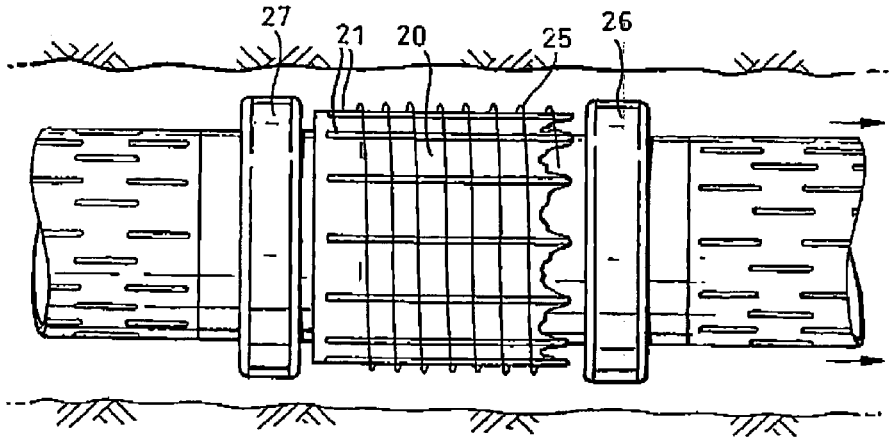
FIG. 4 is a side view of the sealing ring of FIG. 3 in its expanded form.

To protect the sealing rings 6 during the descent of the liner 4 through the wellbore 9 the free ends 7 of sealing rings 6 are wrapped around the liner 4 by a tape (not shown) before installation. The tape may be made of a plastic which slowly dissolves downhole and/or may be provided with a bonding agent that looses its bonding ability downhole so that the tape is released and removed and the free end 7 expands against the borehole wall 8 when the liner 4 has reached its downhole destination. FIGS. 3 and 4 show an alternative embodiment of a sealing ring configuration according to the invention. In this embodiment the sealing ring comprises a rubber or other elastomeric membrane 20 which is expanded like an umbrella by means of a series of spring blades 21 which are secured at their downstream end to the outer wall of the production liner 22.

The arrows illustrate in FIG. 3 how the expanded membrane 20 provides a fluid seal in the annulus 23 surrounding the production liner 22 that minimizes longitudinal flow through the annulus 23 and promotes the fluids to flow directly through the slots 24 into the liner 22.

FIG. 4 shows how the membrane 20 and spring blades 21 are, during descent of the liner into the well, wrapped around the liner 22, by means of a tape 25 which slowly dissolves downhole. Protection rings 26 and 27 protect the unexpanded sealing ring from damage as a result of the movement of the liner 22 through the borehole during installation.

It will be understood that the spring blades 21 may overlap each other such that a diaphragm type of expandable sealing ring is created, in which case the membrane 20 may be omitted.

The invention claimed is:

1. A method for reducing longitudinal flow of fluids through an annular space surrounding a permeable well tubular-in an inflow region of an oil and/or gas production well, the method comprising:

arranging at least one resilient sealing ring around the permeable tubular before lowering the tubular into the well;

constraining the ring in a collapsed position around the tubular by means of a tape and/or binder which gradually dissolves in a downhole environment;

placing the tubular in the inflow region of the well; and allowing the tape and/or binder to dissolve thereby allowing at least part of the resilient sealing ring to expand radially in the annular space surrounding the permeable tubular.

2. The method of claim 1, wherein a series of resilient sealing rings are arranged at regular longitudinal intervals along the length of the permeable tubular.

3. The method of claim 2, wherein each sealing ring has one end which is permanently clamped to the permeable tubular and a resilient lip-shaped other end which is temporarily clamped around the tubular during installation of the tubular in the well and which is released after installation such that the resilient lip-shaped other end unfolds itself and expands radially.

4. The method of claim 3, wherein the resilient lip-shaped other end of each sealing ring is temporary clamped around the tubular during installation using a tape and/or binder which dissolves gradually in the downhole environment.

5. The method of claim 3, wherein permanently clamped end of each sealing ring is located downstream of the resilient lip-shaped other end of the ring.

6. A sealing system for use in the method for reducing longitudinal flow of fluids through an annular space surrounding a permeable well tubular of claim 1, said system comprising a series of sealing rings arranged at regular longitudinal intervals around a permeable well tubular, each ring having one end which is permeably connected to the outer wall of the tubular and another resilient lip-shaped other end.

* * * * *